United States Patent [19]

Tropeano et al.

[11] 3,964,682

[45] June 22, 1976

[54] METHOD AND APPARATUS FOR MAKING SNOW PRODUCED BY CUMULATIVE CRYSTALLIZATION OF SNOW PARTICLES

[76] Inventors: Philip L. Tropeano, 12 Revere St.; Joseph C. Tropeano, 20 Revere St., both of Lexington, Mass. 02173

[22] Filed: Mar. 17, 1975

[21] Appl. No.: 558,821

[52] U.S. Cl. ..... 239/2 S; 239/14

[51] Int. Cl.[2] ..... F25C 3/04

[58] Field of Search ..... 239/2 S, 14; 62/74

[56] References Cited

UNITED STATES PATENTS

| | | | |
|---|---|---|---|
| 3,567,117 | 3/1971 | Eustis | 239/2 S |
| 3,596,476 | 8/1971 | Jakob et al. | 239/2 S |
| 3,761,020 | 9/1973 | Tropeano et al. | 239/2 S |
| 3,822,825 | 7/1974 | Dupre | 239/14 |

*Primary Examiner*—John J. Love

*Attorney, Agent, or Firm*—Munroe H. Hamilton

[57] ABSTRACT

A mixture of compressed air and pressurized water is ejected from snow-making nozzle means in a cold ambient atmosphere and the mixture is expanded and cooled to form a stream of falling snow particles. Into this stream, high velocity jets of chilled water droplets are discharged at points ahead of the nozzle means along generally converging paths of travel. Water droplet portions adhering to the snow particles undergo progressive freezing to produce a cumulative crystallization and growth in the size of the snow particles. The water droplets are jetted at a velocity greatly exceeding the velocity of the snow particles in the stream, and these particles are accelerated and caused to travel over greatly extended distances for a given flow of compressed air supplied, for example, at a rate customarily utilized of one hundred cubic feet per minute. The quantity of water which can be utilized for this rate of flow of compressed air, customarily about twenty gallons, may be increased to as much as fifty gallons with a resultant substantial increase in quantity of crystallized snow particles produced to provide a ground cover. By regulating the quantity of water droplets utilized, the wetness or dryness of the snow may be controlled in a desirable manner.

11 Claims, 12 Drawing Figures

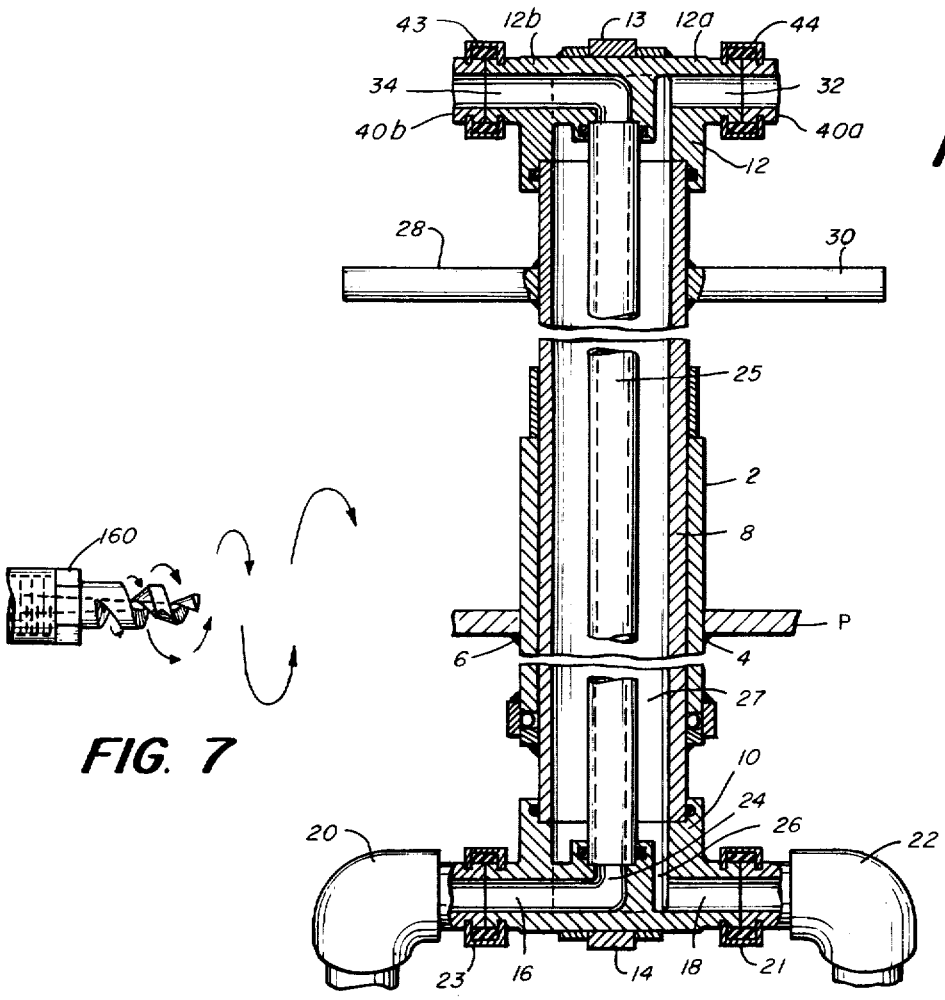
FIG. 3
FIG. 7
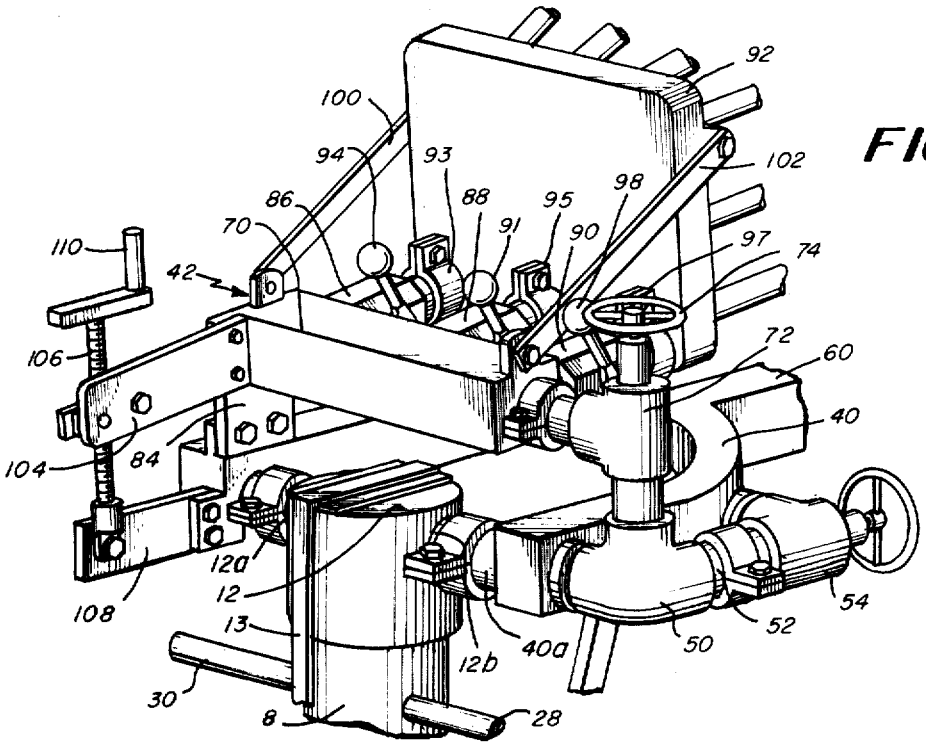
FIG. 4

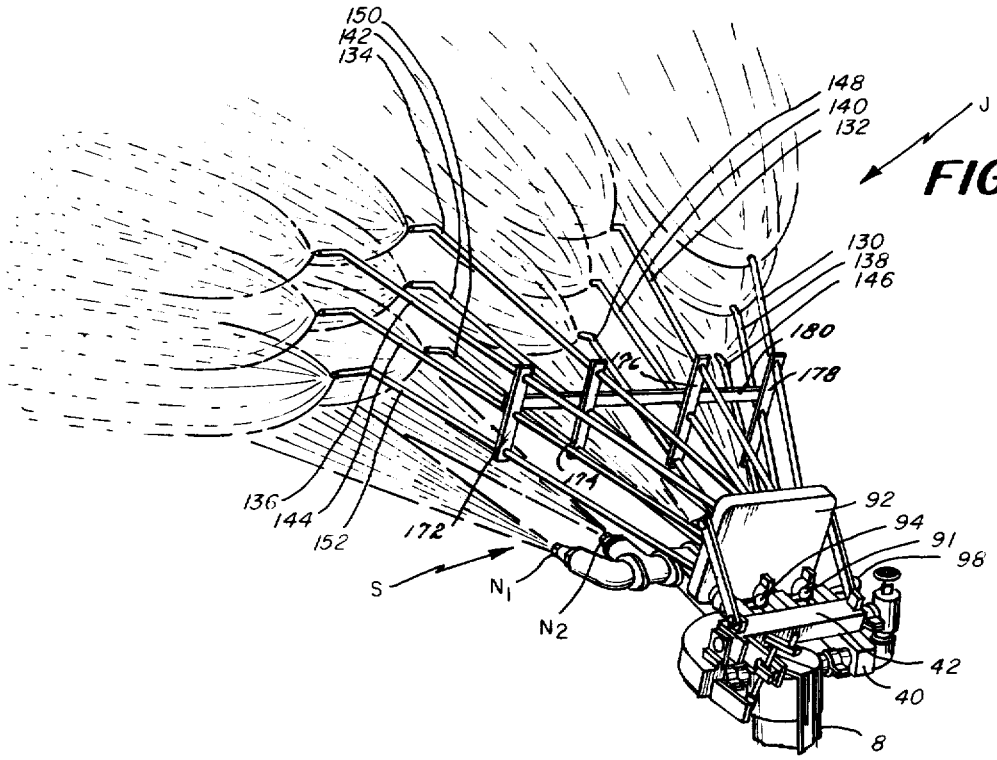
FIG. 10
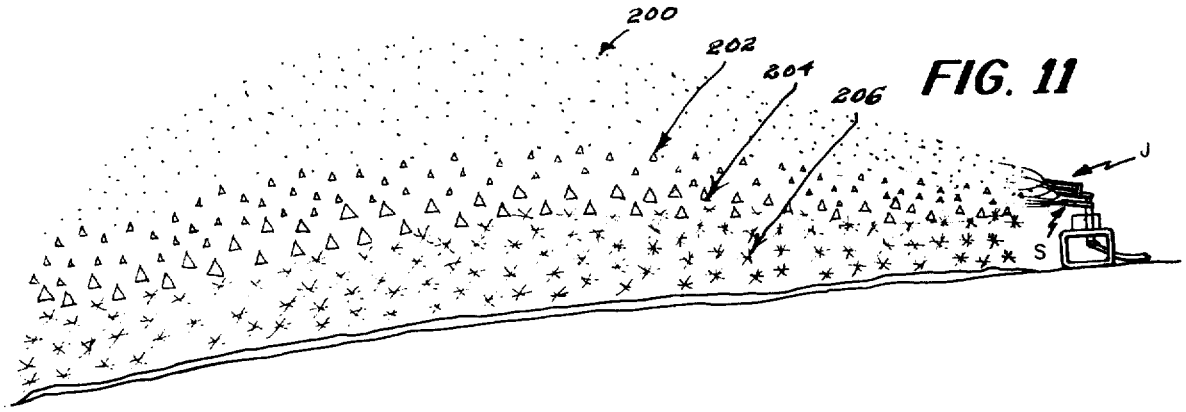
FIG. 11
FIG. 12
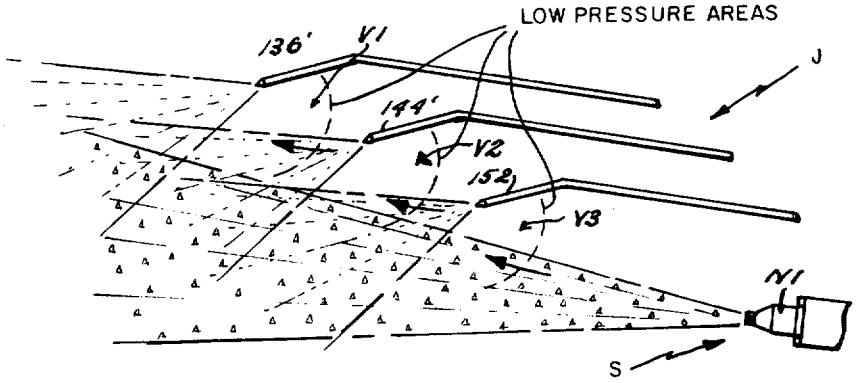

METHOD AND APPARATUS FOR MAKING SNOW PRODUCED BY CUMULATIVE CRYSTALLIZATION OF SNOW PARTICLES

BACKGROUND OF THE INVENTION

Rapid expansion in the ski industry and the facilities for skiing have created an increased demand for snow-making equipment. In addition, many skiing areas have experienced unfavorable weather conditions, greatly restricting the snow fall normally taking place in these areas with the result that there is a need for improved snow-making devices which can be operated more efficiently.

In the art, it is well-known to mix compressed air and pressurized water in a cold ambient atmosphere to produce a stream of snow particles as disclosed most recently, for example, in U.S. Pat. No. 3,761,020, and also a number of earlier patents, including U.S. Pat. Nos. 3,408,005; 3,010,660; 3,298,612; 3,301,485; 3,464,625; 3,596,476; 1,596,577; and 552,345. In all of these techniques disclosed in the prior art, limiting factors are present restricting the quantity and quality of snow which can be made under optimum conditions, as well as the distance over which the snow may be spread in a practical manner over a ski slope area.

The costs involved in operating snow-making equipment is an important consideration especially as temperature is a controlling factor. As is well-known to those skilled in the art, in order to carry out a snow-making operation, it must be done in a cold ambient atmosphere at temperatures ranging from at least 28° F. downwardly. It is also a clearly recognized fact that with presently existing methods of snow-making there can be utilized only a limited quantity of water for a given flow rate of compressed air, and as a consequence, the expense incurred in supplying compressed air and water is relatively high. Still another troublesome factor is that fluctuating wind velocities and rapid temperature changes can result in the production on the one hand of fine crystal snow which is subject to being blown away by wind forces, or on the other hand, the crystals may be of a nature such that a heavy wet snow of a less desirable character may be produced.

SUMMARY OF THE INVENTION

The present invention is concerned with improved methods of making snow of a desired quality on a scale which is commercially feasible and efficient for use on ski slopes. More specifically, the invention is directed to improved apparatus for utilizing separately supplied quantities of pressurized water and compressed air in a more efficient manner.

It is a chief object of the invention, therefore, to provide improved methods and techniques for making snow and producing crystallized snow particles of improved consistency and quality from the standpoint of spreading a snow cover on a ski slope.

Another object is to devise a method and apparatus for increasing the quantity of snow which can be produced for a given flow rate of compressed air.

Still another object is to provide a method and apparatus for controlling a snow-making operation in ways such that a stream of falling snow particles may be travelled outwardly over distances greatly exceeding distances possible with conventional snow-making equipment, and also such that the size of crystallized snow particles as well as dryness or wetness may be desirably regulated.

Summarizing the invention, it has been determined that the foregoing objectives may be realized and in this connection, we have conceived of an improved method of making snow produced by cumulative crystallization of snow particles. My improved method is based on the concept of first ejecting compressed air and pressurized water into a cold ambient atmosphere from a plurality of nozzle members and expanding and cooling the resulting mixture to form a continuously diverging stream of falling snow particles. Into this diverging stream of snow particles, high velocity jets of chilled water droplets may, in accordance with the invention be discharged from points above, below or at either side of the nozzles along generally converging paths of travel.

We have found that by introducing the high velocity water droplets into the diverging stream at points preferably located forwardly of the nozzles from one or more fan-shaped banks of tubular water jets arranged either above or below the nozzles, portions of the water droplets may be caused to adhere to snow particles already formed, and these droplet portions are induced to freeze on the first-formed particles to produce a cumulative crystallization and growth in the size of particles falling to the ground. As a result of this, we are enabled to utilize for a given flow rate of compressed air, substantially increased quantities of water of an order of magnitude of from two to three times the gallonage of water heretofore utilized. We find that by thus increasing the gallonage of water utilized, greatly increased quantities of snow particles may be produced with significant improvement in snow-making efficiency.

We have also discovered that by discharging the chilled droplets at velocities ranging, for example, from two to four times the velocity of the stream of snow particles leaving the snow-making nozzles, it becomes possible to accelerate the speed of travel of the snow particles already formed and to materially extend the distance of travel of falling particles thereby providing extended areas of snow cover on a ski slope.

We have still further determined that by regulating the quantities of water droplets utilized and the points of injection of droplets into the stream of snow particles, we may desirably control the size of cumulative crystallized particles falling to the ground, as well as the wetness or dryness of such particles as required under any given set of snow-making weather conditions.

In carrying out the above-noted method steps of the invention, we have further devised a novel water jet structure which, in one preferred form, may comprise a plurality of fan-shaped banks of tubular jets combined with a snow-making nozzle apparatus as shown in the accompanying drawings noted below.

BRIEF DESCRIPTION OF THE DRAWINGS

FIG. 3 is a vertical cross section taken on the line 3—3 of FIG. 1.

FIG. 4 is a fragmentary perspective view of a water jet structure of the invention.

FIG. 7 is a detail elevational view of water ejector means for discharging high velocity water droplets.

FIG. 10 is an elevational view of the banks of tubular jets shown in FIG. 9 and further illustrating diagrammatically water droplets being discharged into a travelling stream of snow particles.

FIG. 11 is a view illustrating diagrammatically cumulative crystallization and growth in size of falling snow particles.

FIG. 12 is another diagrammatic view illustrating movement of snow particles induced by suction forces created by successive water jet members.

DETAILED DESCRIPTION OF THE INVENTION

Figure 1:
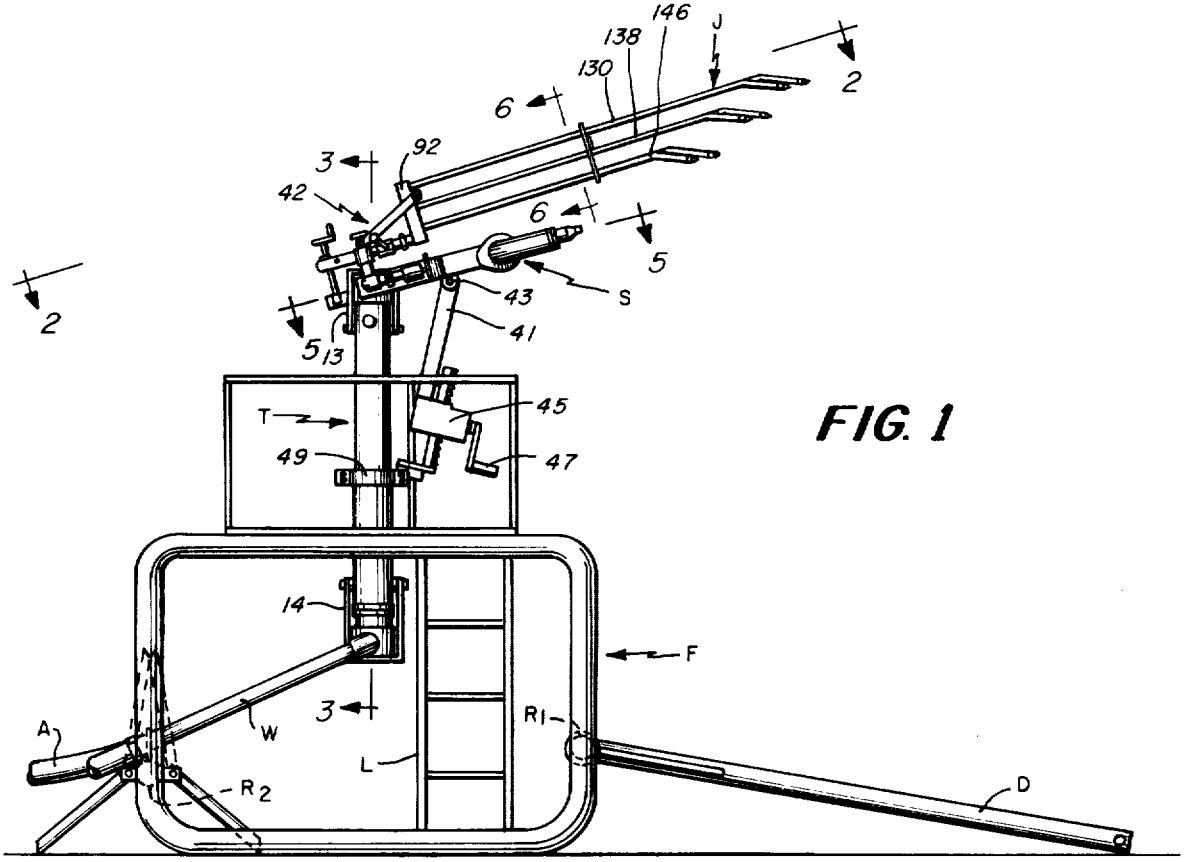
FIG. 1 is a side elevational view of a preferred form of snow-making apparatus of the invention.

The structure shown in the drawings constitutes one preferred means of carrying out the method of the invention and generally includes snow-making nozzle means, a multiple water jet structure superimposed upon the nozzle means and conduit means for furnishing independently supplied flows of compressed air and pressurized water to both the nozzle means and the water jet structure. These flows are provided by conventional air compressor and water pump equipment which is not shown in the drawings, but is indicated in the form of compressed air and water pipes A and W, respectively, as shown at the left hand sides of FIGS. 1 and 2.

Figure 2:
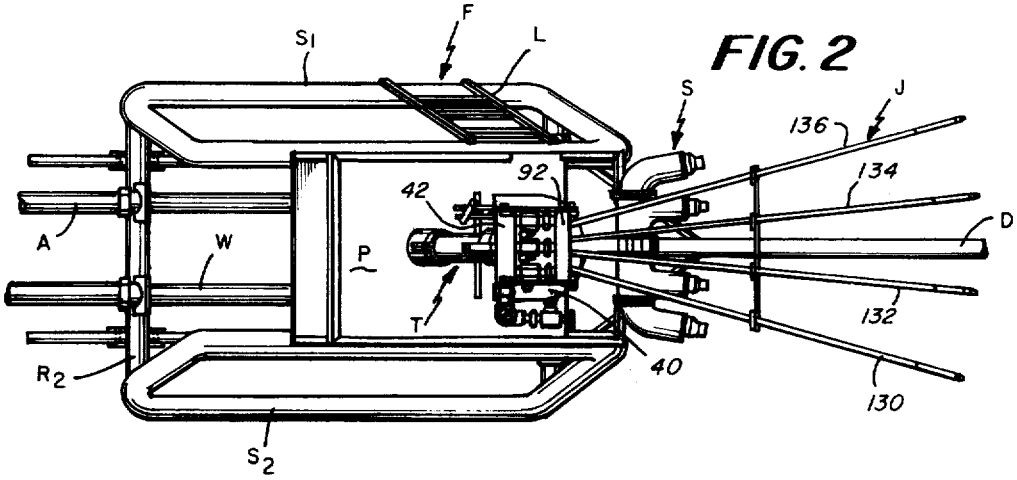
FIG. 2 is a plan view of the structure shown in FIG. 1.

Referring more in detail to FIGS. 1 and 2, arrow F denotes a portable frame designed to be moved about along a ski slope and to support the snow-making equipment of the invention in an elevated position. Vertically disposed in the frame structure is a snow-making nozzle apparatus indicated by arrow S, and mounted above the snow-making nozzle apparatus is a multiple water jet structure generally indicated by the arrow J.

The frame F is made up of spaced apart tubular sides S1 and S2 joined together by front transverse rods R1 and R2. Solidly supported between upper sections of the sides S1 and S2 is a platform P on which an operator stands to control and direct the snow-making apparatus along desired areas. Ladder member L permits ready access to the platform which may be of a height of 4 to 5 feet or more. Attached to the frame is an arm D which can be secured to a truck or other vehicle for moving the frame into a desired position.

Rigidly secured in the platform P is a nozzle-supporting tower structure generally indicated by arrow T, and including an outer stationary casing part 2 which is welded or otherwise attached to the platform, for example, at points 4 and 6. Rotatably received in the casing 2 is a cylindrical conduit member 8 having a bottom end sealably supported in a lower pipe fitting member 10 and an upper end sealably received in an upper pipe fitting member 12. The lower fitting member 10 is supported in a hanger strap assembly 14, upper extremities of which are pinned to opposite sides of the casing 2 as shown in FIG. 1.

At two opposite sides of the lower fitting 10 are formed water and air inlets 16 and 18 to which are connected the water and air pipes W and A, by elbows 20 and 22 and couplings 21 and 23. Formed at an upper side of the pipe fitting member 10 is a water outlet 24 and an air outlet 26. The outlet 24 is connected to a vertical conduit member 25 and the outlet 26 communicates with an air chamber 24 surrounding the member 25. Hand bars 28 and 30 provide for an operator turning the cylindrical conduit 8 about a vertical axis in the lower fitting. The upper fitting member 12 is fastened to the cylindrical conduit 8 by means of a retaining strap assembly 13, ends of which are pinned to opposite sides of conduit 8, as shown in FIG. 1. By means of this arrangement, the fitting 12 may be rotated with the conduit 8.

At either end of the fitting 12 is provided angularly disposed tubular conduit sections 12*a* and 12*b*, as shown in FIG. 3. The conduit section 12*a* is formed with an air passageway 32 with which the air passageway 27 communicates. Conduit section 12*b* is formed with a water passageway 34 with which conduit 25 connects, as shown. Mounted for rotative movement about a horizontal axis at outer ends of the tubular conduit sections 12*a* and 12*b* is a dual manifold assembly including a lower nozzle manifold 40 and a tilting water jet manifold structure supported at the upper side of the manifold 40 and generally indicated by the arrow 42.

Figure 5:
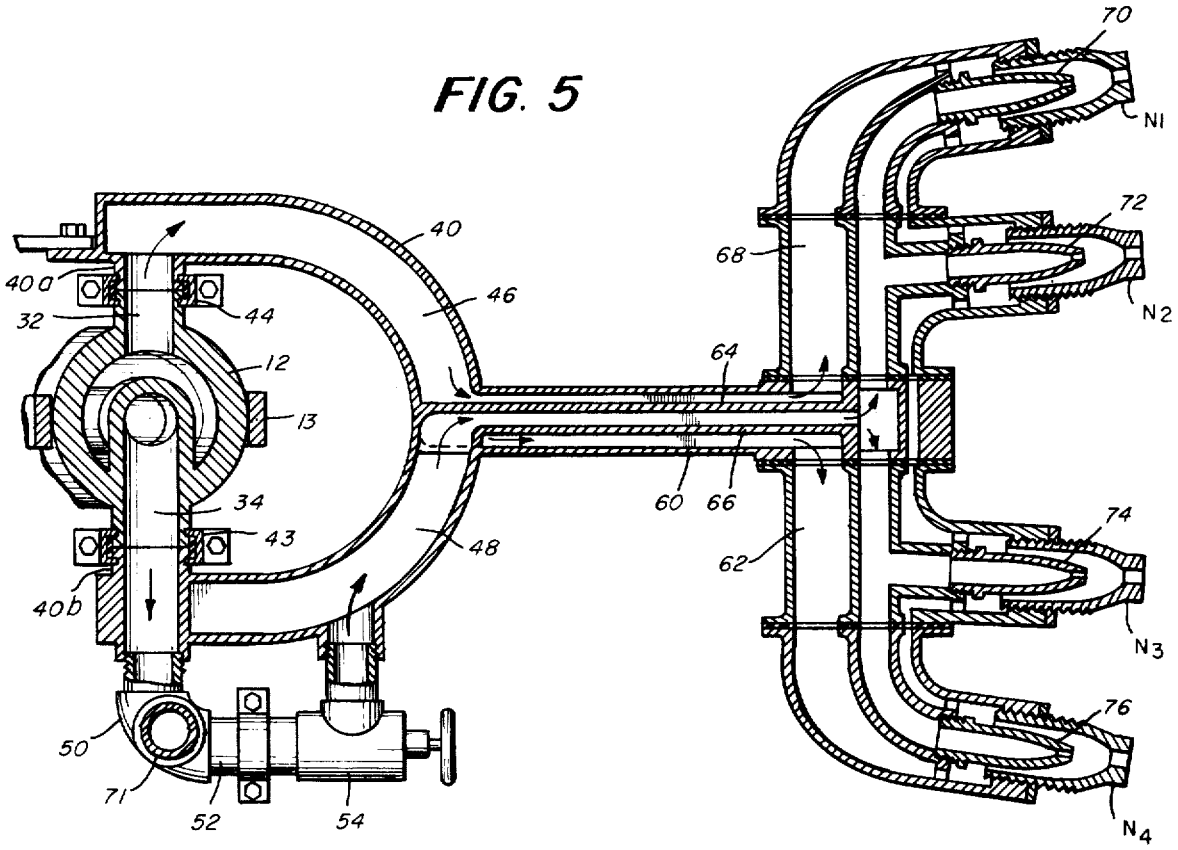
FIG. 5 is a cross section taken on the line 5—5 of FIG. 1.

The lower manifold structure 40 is of U-shaped form and constructed with tubular extensions 40*a* and 40*b*, more clearly shown in FIGS. 4 and 5. These extensions 40*a* and 40*b* are sealably coupled to respective fitting sections 12*a* and 12*b* by couplings 43 and 44. There is thus provided by the manifold 40 an air duct 46 which is in communication with the air passageway 32. Similarly the opposite side of the manifold has a water passageway 48 which is in communication with the water passageway 34 through coupled tubular connecting parts 50, 52 and 54. A valve 56 regulates the flow of water into passageway 48.

The manifold 40 is supported at its underside by means of an adjustable arm 41, most clearly shown in FIG. 1. At its upper end, arm 41 is pivotally attached to a lug 43 on the manifold and the arm at its lower end includes a rack and pinion device 45 which is manually operated by a crank 47. A lower end of the rack and pinion device is solidly anchored to a collar member 49, clamped around the conduit 89, shown in FIG. 1. It will be observed that by means of the arrangement of parts described, the vertical conduit 8 may be swiveled through any desired arc of travel carrying with it the dual manifold assembly in any selected position into which the structure is swiveled. The entire manifold assembly may also be independently tilted upwardly or downwardly into various positions of inclination with respect to a ground area which is to receive a snow cover.

It is pointed out that the manifold 40 is designed in shape and size so as to constitute a relatively long pre-cooling conduit for both water and air, and at its front side, the manifold is further formed with additional pre-cooling conduit means consisting in an elongated tubular extension part 60, through which compressed air and water is received from air passageway 46 and water passageway 48, and supplied to a gang of snow-making nozzles N1, N2, N3, N4 arranged in horizontally spaced apart diverging relationship at the front side of a nozzle housing 62.

In the extension part 60 numeral 64 denotes an air duct and 66 denotes an inner conduit part. Air duct 64 communicates with an air passageway 68 which supplies compressed air to each of the nozzles N1, N2, N3 and N4. Similarly, conduit 66 supplies water under pressure to passageway 68 communicating with each of the tubular water tubes 70, 72, 74 and 76. The apparatus described operates to discharge from the nozzles N1, N2, N3 and N4, a mixture of pre-cooled compressed air and pressurized water into a cold ambient atmosphere to produce a diverging stream of snow particles. In a typical snow-making operation, the pressure of water supplied is controlled through the valve member 54 to be at a pressure of, for example, 20 p.s.i. for a flow of compressed air furnished at 100 cubic feet per minute.

Considering next the multiple water jet structure of the invention for discharging high velocity jets of chilled water droplets into the discharging stream of snow particles produced by the nozzles N1, N2, N3, N4, attention is directed to the manifold 42. This structure is supported above the manifold 40, as is most clearly shown in FIG. 4, and constitutes conduit means through which water is supplied to the banks of water jets J shown in FIGS. 1 and 2. Included in the manifold structure 42 is an elongated header member 70 into which pressurized water is received through a conduit part 71 connected to a valve body 72 and controlled by a valve member 74, most clearly shown in FIG. 5. At one end the header 70 is formed with a tubular extension part 76 which is sealably connected to a reduced end 78 of the valve body 72 by a slip coupling 80 in which the part 76 is free to turn. At its other end the header 70 is formed with a stub shaft 82 which is rotatably mounted in a vertical bracket member 84 (FIG. 6) secured at the upper side of the manifold 40.

Figure 6:
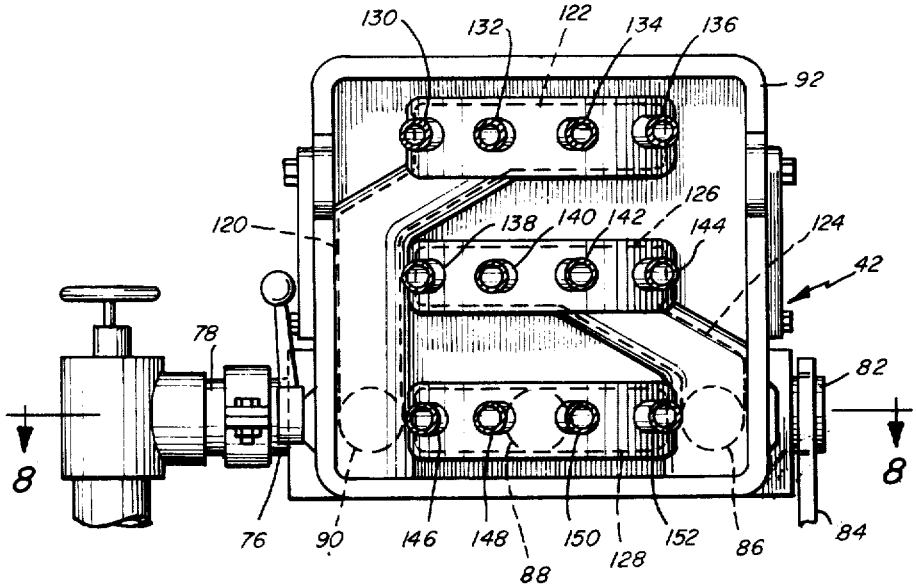
FIG. 6 is a cross sectional view taken on the line 6—6 of FIG. 1.

Connected into the header 70 are short conduits 86, 88, 90 which are in turn connected by couplings 93, 95, 97 into vertical header 92. Flow of water through these conduits into the manifold is selectively controlled by valves 94, 96, 98. At either side of the manifold are attached reinforcing arms 100, 102 anchored to the header 70, as shown in FIG. 4 of the drawings. The tilting manifold structure is normally located in a desired fixed position by an adjustment arm 104 having a threaded sleeve engageable by a screw member 106 anchored in a bracket part 108. A handle 110 provides for manually raising or lowering the tilting manifold structure independently of the manifold 40. As shown in FIG. 6, the manifold member 92 is chambered to provide sets of water outlets which are arranged one above another and which are selectively supplied with water from the conduits 86, 88, 90. Thus as indicated in dotted lines in FIG. 6, the conduit 90, under control of valve 98, furnishes water through a channel 124 to a duct 126, and conduit 88, under control of valve 96 furnishes water directly into a duct 128.

Figure 8:
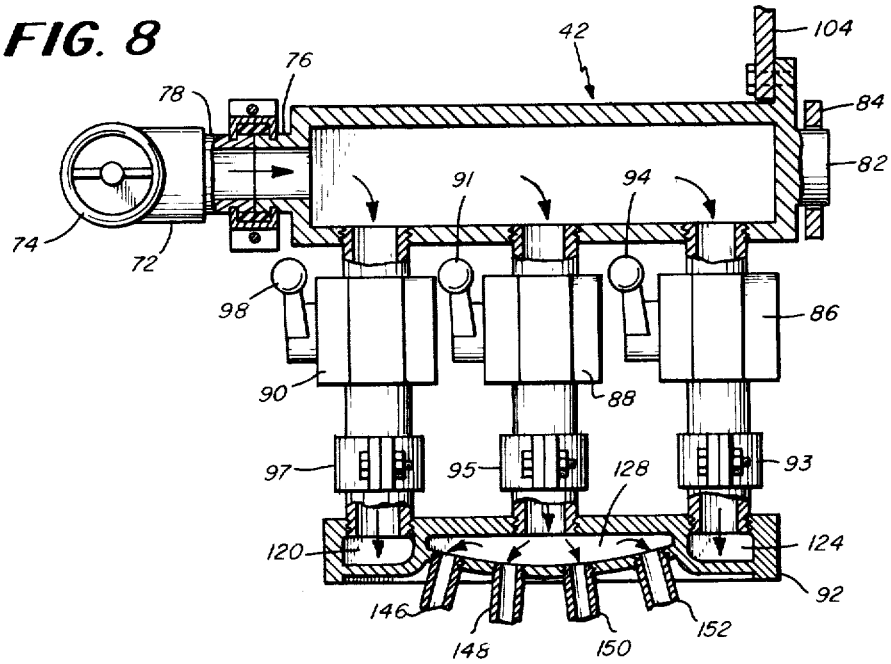
FIG. 8 is a cross section taken on the line 8—8 of FIG. 6.

Connected with the above-noted sets of outlets in the manifold 92 are respective banks of tubular water jets arranged in tiers one above another, as shown in FIG. 8 and including an upper bank made up of the tubular jets 130, 132, 134, 136 and an intermediate bank made up of tubular water jets 138, 140, 142, 144, and a lower bank of tubular jets 146, 148, 150 and 152. As shown in FIG. 2, the water jets are supported in diverging relationship to one another and in a typical installation, the jets in the upper bank may be of a length, for example, of seven feet, and may be horizontally separated at their outer ends a distance, for example, of two to five feet. Jets in the intermediate bank may be located below the upper bank of jets a distance, for example, of one foot and may be of a length of, for example, 6 feet. Jets of the lower bank may be of a length for example, of 5 feet and also spaced 1 foot below jets of the intermediate bank. The angle of divergence of the jets may be generally related to the angle of divergence of the nozzles in a manner such that the area over which a stream of snow particles from the nozzles N1, N2, N3, N4 is projected may be encompassed or exceeded by the area through which jets of chilled droplets are discharged, as indicated diagrammatically in FIG. 10. In thus locating the tubular water jets in spaced diverging relationship, we may desire to employ rigid spacer elements which are indicated in the drawings as numerals 172, 174, 176 and 178, separated by a transverse spreader 180.

Figure 9:
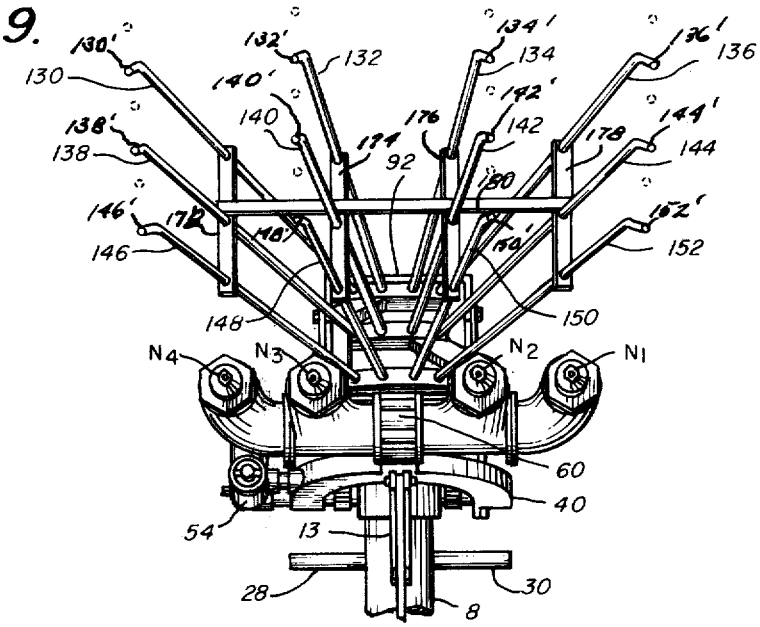
FIG. 9 is a front elevational view of a water jet structure showing banks of tubular water jets arranged in vertically spaced tiers.

An important feature of the water jet structure described is the provision at the outer ends of the tubular members of special fog nozzles 130', 132', 134', 136', 138', 140', 142', 144', 146', 148', 150', 152', best shown in FIG. 9. A typical form of this fogging nozzle is illustrated in FIG. 7 and generally denoted by the numeral 160. Fogging nozzles of this class are characterized by helical vanes which taper outwardly to a tip in such a manner as to create high velocity spray or fog of droplets which extend outwardly in a rapidly expanding bushy pattern as described more clearly in U.S. Pat. Nos. 2,804,341, 2,518,116, 2,612,407. High velocity sprays of bushy pattern have been indicated diagrammatically at the upper left hand side of FIG. 10. In thus discharging high velocity jets of water droplets, particularly under a pressure of, for example, 50 p.s.i., there is created low pressure areas or vacuum pockets immediately in the rear of each nozzle part, as has been shown diagrammatically in FIG. 12 and indicated at the areas V1, V2, V3. We have found that by suitably spacing these fog nozzles in relation to one another, a low pressure area of a forward nozzle tends to accelerate the speed of flow of a spray from an immediately succeeding nozzle. Thus there may be realized an acceleration effect of an appreciable nature which acts to increase the overall velocity of the several flow emitted at any given time. It is found that this induced acceleration occurring as the droplets are dropping into a stream of snow particles can augment appreciably the velocity of these snow particles and can provide a longer period for water droplet portions adhering to snow particles to freeze.

In operating the snow making nozzles and the fog nozzles in combination to carry out cumulative crystallization of snow particles, a important factor is use of suitable water pressure in a selective manner. Thus in conventional snow-making, it is customary to supply air at a flow rate of 100 cubic feet per minute, and at the same time to supply a flow of water at a pressure of, for example, 20 p.s.i. However, carrying out the method of the invention, greatly improved results can be obtained by providing a source of pressurized water at much greater pressures as, for example, 50 p.s.i. In order to maintain a correct water pressure of, for example, 20 p.s.i. at the nozzles N1, N2, N3, N4, the flow of water is throttled through a valve body 54, while by-passing the valve body 54 for the fogging nozzles and continuing to conduct water at 50 p.s.i. through the main valve body 72.

With water and air pressures thus regulated at desired values, the frame F may be moved into a desired area. The snow-making nozzles together with the water jet structure is then swiveled into a desired position by rotating the handles 28 and 38. Thereafter the manifold structure 40 is adjusted into a suitable angle of inclination of the ski slope to be covered and the snow-making nozzles are started to produce a stream of snow particles. As soon as this is done, the tilted manifold structure 70 is adjusted relative to the stream of particles from the nozzles, depending upon temperature and wind conditions encountered. With water flowing through the manifold structure 70, a discharge of jets of chilled water droplets into the stream is begun.

As shown in FIG. 11, the tiny droplets indicated at 200 are discharged in a bushy mass from points above a stream of snow particles 202 emitted from the snow-making nozzles. Portions of these falling droplets adhere to the snow particles as suggested diagrammatically at 204 and thereafter freezing of the snow particles and the adhering portions of water droplets takes place to provide the cumulatively crystallized snow particles as indicated at 206. With the tiny water droplets 200 travelling at velocities greatly exceeding the velocity of the particles 202, there is achieved an extension of the falling mass of a very significant nature.

Under optimum weather conditions, all three of the banks of water jets noted may be placed in operation if desired. However assuming weather conditions make it necessary, one or more of the banks of jets may be held out of operation by use of one or more of the control valves 94, 96 and 98. It should be understood under some temperature conditions, greater or lesser amounts of water droplets may be discharged in order to control the wetness or dryness of the snow. In a typical optimum operating condition, it has been found that the accelerated stream of cumulative crystallized snow particles may be traveled outwardly through distances as great as two hundred feet or more in comparison with conventional methods providing for travel of only 50 to 60 feet. There is thus realized a significant increase in snow cover applied during a unit period of time.

In the preferred form of the invention shown in the drawings, the water jet means is located above the snow-making nozzles. However, we may wish to employ a water jet structure supported at the under side of the nozzle or at either side thereof or at all points around the nozzles.

We claim:

1. In a method of making snow in which a mixture of compressed air and water under pressure is ejected from snow-making nozzle means in a cold ambient atmosphere and the mixture is expanded and cooled to form a stream of falling snow particles, the steps which include discharging high velocity chilled fluid jets into the falling snow particles from a plurality of jet nozzles occurring one above another in forwardly spaced relationship under a pressure of approximately 50 lb. p.s.i. to form vacuum pockets immediately in the rear of each nozzle extremity, spacing the jet nozzles apart from one another distances at which vacuum pockets of forwardly located nozzles induce acceleration of fluid jets discharged from jet nozzles located immediately rearwardly of the said forwardly positioned nozzles, and increasing the velocity of falling snow particles into which the accelerated fluid jets are discharged.

2. A method according to claim 1 in which the discharge of high velocity jets of chilled water droplets is controlled to vary the physical characteristics of the snow particles.

3. A method according to claim 1 in which the quantity of water utilized is increased relative to the flow of compressed air to provide materially increased efficiency in the snow-making process.

4. In a method of making snow in which a mixture of compressed air and water under pressure is ejected from snow-making nozzle means in a cold ambient atmosphere, and the mixture is expanded and cooled to form a stream of snow particles, the steps which include discharging high velocity jets of chilled water droplets downwardly from points above and in front of the said nozzle means and into the stream of snow particles and progressively freezing water droplet portions adhering to the falling snow particles to produce cumulative crystallization and growth in the size of the said snow particles, and the said jets of chilled water droplets are discharged at a velocity in a range of from two to three times the rate of travel of the snow particles in the stream, and thereby extending the distance of travel of the cumulatively crystallized particles throughout a distance ranging from three to four times the distance normally travelled by particles from the said nozzle means.

5. In a method of making snow to be spread over a ski slope as a snow cover in which method a quantity of pressurized water is mixed with a flow of compressed air supplied at a rate required to convert the said predetermined quantity of pressurized water to snow particles at conventional snow-making temperatures, and the mixture of pressurized water and compressed air is ejected from snow-making nozzle means in a cold ambient atmosphere and expanded and cooled to form a stream of falling snow particles, the steps which include supplying independently conducted flows of water under pressure, discharging the independently conducted flows in the form of high velocity chilled water droplets into the stream of snow particles from points above and ahead of the nozzle means, and freezing water droplet portions which adhere to falling snow particles, thereby to increase the quantity of water which may be converted to snow by the said compressed air flow rate and produce a larger snow cover over the said ski slope.

6. A method according to claim 5 in which the rate of flow of the compressed air is approximately 100 cubic feet per minute and the quantity of pressurized water furnished to the nozzle means is supplied at a rate of approximately fifty gallons per minute.

7. A method according to claim 5 in which the flow of compressed air is furnished at 100 p.s.i. and the pressurized water is furnished at 250 p.s.i. for discharging water droplets and the water furnished to the said nozzle means is under pressure of 100 p.s.i.

8. Improved snow-making apparatus comprising means for furnishing independently supplied flows of compressed air and pressurized water, tubular nozzle means for ejecting a mixture of the air and water into a cold ambient atmosphere to form a stream of snow particles, a plurality of jet nozzles located one above another in forwardly spaced relationship in a position to discharge fluid jets into the said stream of particles, means for conducting from the said supply of pressurized water, flows of fluid under pressures ranging upwardly to 50 lbs. p.s.i. into the said jet nozzles from which nozzles high velocity chilled fluid jets are discharged to form vacuum pockets immediately in the rear of each nozzle extremity, said nozzle extremities being spaced apart from one another distances at which vacuum pockets of forwardly located nozzles induce acceleration of fluid jets discharged from jet nozzles located immediately rearwardly of the said forwardly positioned nozzles.

9. Improved snow-making apparatus comprising means for furnishing independently supplied flows of compressed air and pressurized water, tubular nozzle means for ejecting a mixture of the air and water into a cold ambient atmosphere to form a stream of snow particles, conduit means including an elongated vertical enclosure body formed with an inner and outer passageway for receiving the independently supplied flows of air and water and conducting them along the enclosure body in separated relationship to one another, said enclosure body formed at its upper end with outlet ports, a dual manifold structure connected to the outlets and communicating with the tubular nozzle means and a multiple water jet structure also connected to the manifold structure and mounted above the nozzle means for directing a plurality of jets of water droplets into the stream of snow particles.

10. A structure according to claim 9 in which the multiple water jet structure includes a plurality of vertically spaced apart banks of tubular jet members, and valve means in the dual manifold structure for selectively controlling flow of pressurized water into tubular jets in any one of the said banks.

11. Improved snow-making apparatus comprising a portable frame, a snow-making apparatus vertically disposed in the frame and rotatable about a vertical axis, means for furnishing independently supplied flows of compressed air and pressurized water, a vertical enclosure body supported in the frame and independently connected to the flows of compressed air and pressurized water, tubular nozzle means mounted on the enclosure body and connected to the flows of air and water at the upper side of the enclosure body for ejecting a mixture of the compressed air and pressurized water into a cold ambient atmosphere to form a stream of snow particles, adjustment means for turning the nozzle members about a horizontal axis of rotation into desired positions of adjustment in the frame, a water jet structure superimposed on the nozzle means for discharging jets of water droplets into said stream of snow particles, and a tilting mechanism for tilting the water jet structure about a horizontal axis of rotation independently of the nozzle means.

* * * * *